United States Patent [19]

Loffelholz

[11] 4,234,202

[45] Nov. 18, 1980

[54] SKI POLE

[76] Inventor: Eberhard Loffelholz, Thurgauerstrasse 13a, Singen, Fed. Rep. of Germany

[21] Appl. No.: 880,454

[22] Filed: Feb. 23, 1978

[30] Foreign Application Priority Data

Feb. 24, 1977 [DE] Fed. Rep. of Germany ..... 2707959

[51] Int. Cl.[3] ..... A63C 11/22

[52] U.S. Cl. ..... 280/820; 280/821

[58] Field of Search ..... 280/11.37 H, 11.37 B, 280/11.37 D, 11.37 F, 11.37 L, 11.37 A, 11.37 K; 135/66, 65; 224/5 J, 5 Z, 28 A, 28 G, 45 S, 58, 56

[56] References Cited

U.S. PATENT DOCUMENTS

| | | | |
|---|---|---|---|
| 1,498,287 | 6/1924 | Newman | 135/65 |
| 3,232,632 | 2/1966 | Lewis | 280/11.37 H |
| 3,685,850 | 8/1972 | Kepka et al. | 280/11.37 H |
| 3,854,640 | 12/1974 | Willmarth | 224/45 S |
| 3,862,765 | 1/1975 | Goheen | 280/11.37 H |
| 3,879,048 | 4/1975 | Penney | 280/11.37 H |
| 3,992,021 | 11/1976 | Tobin | 280/11.37 H |

FOREIGN PATENT DOCUMENTS

| | | | |
|---|---|---|---|
| 186174 | 9/1955 | Austria | 280/11.37 D |
| 2218731 | 10/1973 | Fed. Rep. of Germany | 280/11.37 A |

*Primary Examiner*—David M. Mitchell

*Attorney, Agent, or Firm*—Hane, Roberts, Spiecens & Cohen

[57] ABSTRACT

A ski pole comprising a tube having a lower pointed end with a transverse member or disc on the tube adjacent the pointed end and a hand grip on the tube at the upper end. The hand grip includes a grip column and a grip guard cooperatively defining a grip opening for receiving the hand of a user. The grip has an upper end constituting an impact surface at the upper end of the pole and the grip includes a block-shape fitting engaging the upper end of the tube. The grip may include a hollow portion which can be filled with pressurized air and which will vary the size of the grip opening. A glove or other suitable skier-engagement member can be connected to the grip by a magnet and the connection is made through a yieldable member which allows the skier-engagement member to be displaced away from the ski pole while remaining connected thereto. The ski pole has magnets which allows the ski pole to be connected to a second ski pole.

8 Claims, 17 Drawing Figures

Fig.5
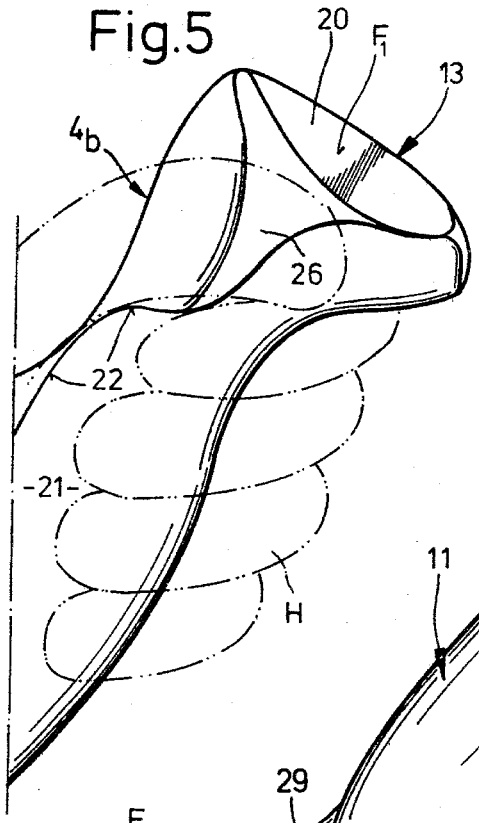
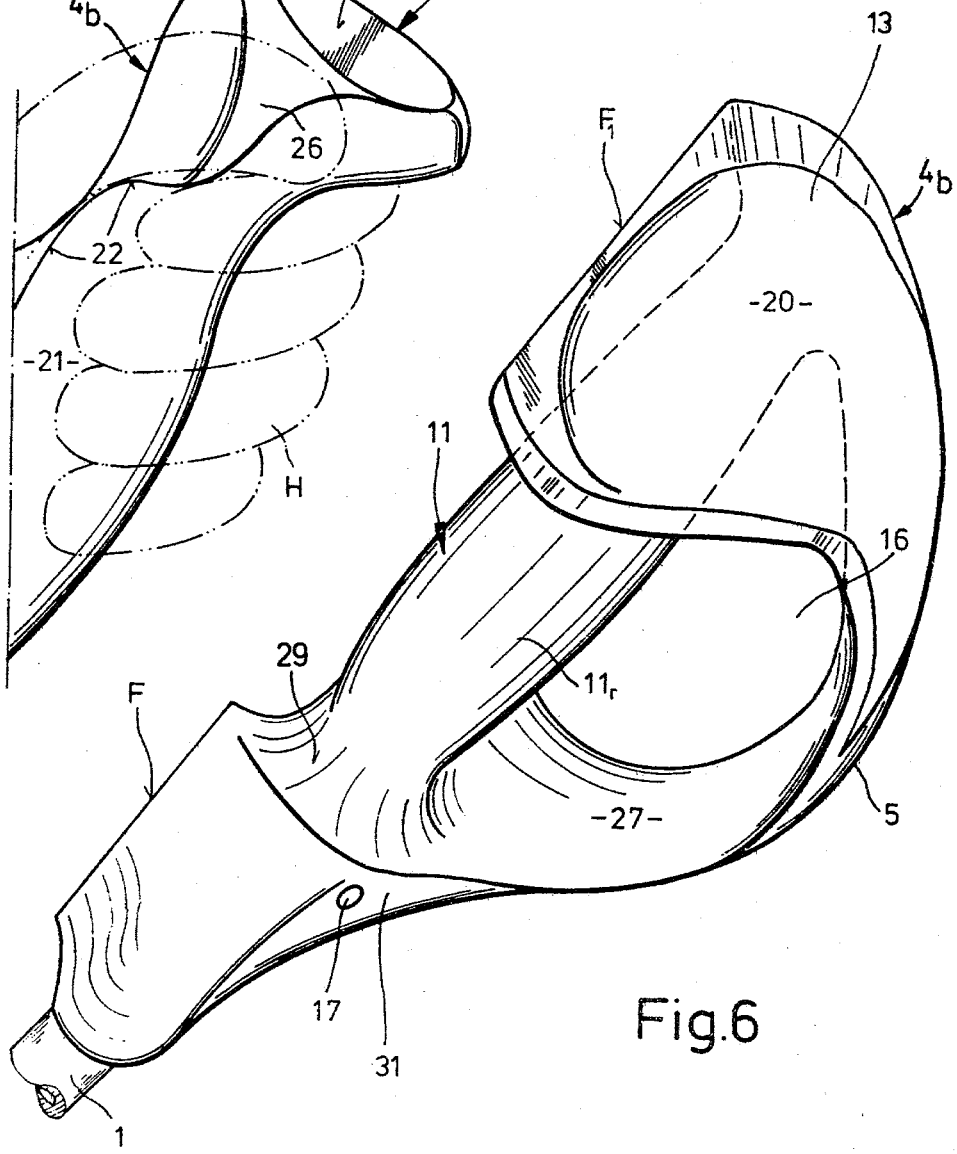
Fig.6

Fig.9
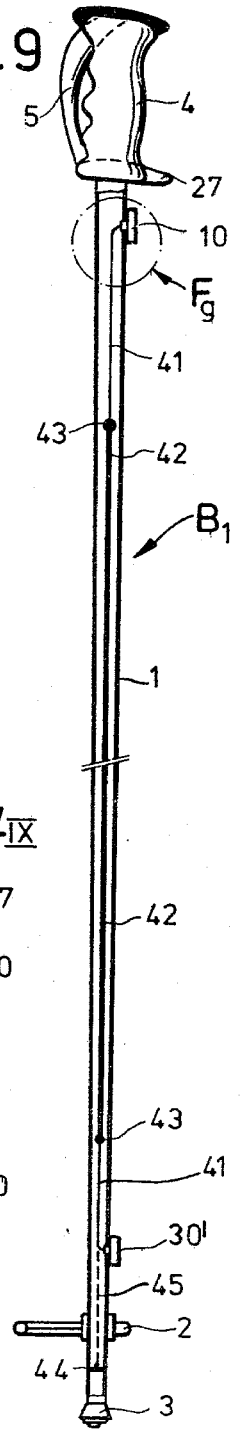
Fig.9a
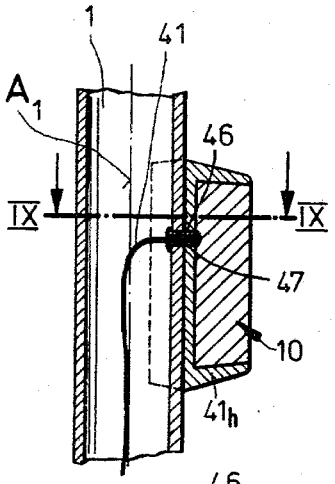
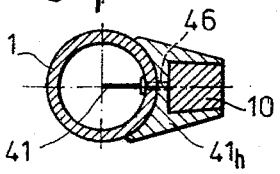
Fig.9b

SKI POLE

FIELD OF THE INVENTION

The present invention relates to a ski pole having at least one disk or similar transverse member adjacent its point and a grip which receives the upper end of the ski pole and with which there is possibly associated a glove or the like, surrounding it.

BACKGROUND

It is known that ski poles must today satisfy special safety requirements both of the skier and of the supervisory authorities. The ski pole grips present on the market and their hand straps no longer satisfy safety expectations. Firstly, the hand is caught in the hand strap and, secondly, the hand is not sufficiently protected from abrasion upon falls. In addition to this, the pommel of the ski pole constitutes a considerable safety risk. In accordance with recent safety regulations, the impact surface of the pommel must be at least 25 $cm^2$ in order to avoid substantial injuries to the face and body upon a fall on the pole.

As a result, pole grips have, it is true, become safer, but as a result of the impact surface described and the use of lateral strap guards which are larger and heavier, the ski poles become top-heavy.

SUMMARY OF THE INVENTION

In view of this an object of the invention is to provide an improved ski pole of the aforementioned type which avoids the defects thereof while making it safer for the user. In this connection, on the one hand, the user's hand is to be protected as far as possible, while on the other hand, the connection between the user and the ski pole is to be made safer.

In order to achieve this, the grip is shaped in a single piece with a grip column and a grip guard which together with the grip column defines a grip opening such that the grip guard and the grip column form an impact surface at the upper end of the ski pole and a block-shaped fitting on the other end of the grip. It lies within the scope of the invention to provide on the ski pole, at least in the region of the grip, an anchoring member which is of limited elasticity and to attach the glove to it.

It has been found particularly favorable for the glove, or an armband fastened on the arm of the user, to have a permanent magnet, which is coupled with the grip and/or the anchoring member by another permanent magnet arranged permanently on the latter. In this connection, in accordance with the invention the anchoring member is connected to the handle by a winding device which, in accordance with another feature of the invention, is arranged in the block-shaped fitting.

The winding device is advantageously part of a cassette-like plug-in member from which there extends a chain, rope or string as an anchoring member which is wound at the other end in the cassette by the force of a spring contained therein. The winding force should be less than the force of adherence between the coupling members connecting the glove or arm on the one hand and the ski pole on the other hand, in order to provide assurance that the ski pole will remain attached to the user even if the pole magnet or the like is at a distance from its pole and remains connected to the latter merely by the chain or the like.

The pole grip is of a special shape in accordance with the invention: the block-shaped fitting has a resting surface, approximately parallel to the pole, for a second ski pole which can be coupled as a mirror image. Another resting surface on the pommel and possibly also on the ski pole disk is advantageously aligned with the resting surface of the fitting.

At the juncture between the block-shaped fitting and the grip guard there is a supporting surface for the inserted hand of the user, the outer edge of whose hand at the same time rests on a shoulder surface provided outside the grip opening on the block-shaped fitting.

A particularly characteristic feature is a helically extending ridge or edge of the grip column which extending transverse to the axis of the grip below the pommel and slightly inclined to the supporting surface forms below the pommel another shoulder surface or supporting surface for the thumb of the gripping hand of the user. The ridge furthermore defines the limit of a flat side surface of the grip column for the fingertips so that the entire hand of the user holds the grip in very reliable manner while additionally the hand other is protected from injury by its embedment.

It lies within the scope of the invention that the ridge or edge extends, below a shoulder surface approximately parallel to the axis of the grip and is formed on the edge of a fin-shaped protrusion which receives the fingertips of even large hands.

It has been found particularly favorable to develop at least the grip guard—and possibly even the grip column—of variable cross section and to change the width of the grip opening, i.e. to adapt it to the size of the hand of the user. In this connection it is not of importance that the hand be seated firmly in the grip since this could increase the danger but rather the hand should continue to lie with clearance, but be protected as a whole, in the grip.

In order to achieve this, at least the grip guard is made inflatable and the necessary valve is provided in a fitting below the supporting surface.

The impact surface of the grip pommel, which has already been described, is made even safer by the fact that the cushion of the pressurized grip guard, which is formed by the pressurized air, continues up to the impact plate, and possibly even forms a separate chamber thereat.

Instead of the anchoring member with the winding device which has been described, the anchoring member can also be suspended from an elastic band or the like in the pole grip—this also being a measure for preventing the sliding away of the ski pole which in itself is harmless. Such a sliding away of the ski pole can become dangerous if the pole, for instance, slips downward on a steep slope. To this extent the coupling of the ski pole to the user in accordance with the invention supplements the known ski stoppers.

Futhermore, discomfort is avoided upon waiting for ski lifts; up to now skiers have been forced to place their ski poles on the side and to hold their gloves generally between their teeth or knees. The gloves can now even remain on the ski poles.

BRIEF DESCRIPTION OF THE DRAWINGS

Further advantages, features, and details of the invention will become evident from the following description of preferred embodiments given with reference to the drawings in which:

FIG. 5 shows the grip end of FIG. 4 in a different oblique view;

FIG. 6 shows the rear of the grip end of FIG. 4;

FIG. 9 is a longitudinal section through another ski pole;

FIG. 9*a* is an enlarged detail of the pole in FIG. 9 at the portion $F_g$ thereof;

FIG. 9*b* is a cross section taken along line IX—IX in FIG. 9*a;*

DETAILED DESCRIPTION

Figure 1:
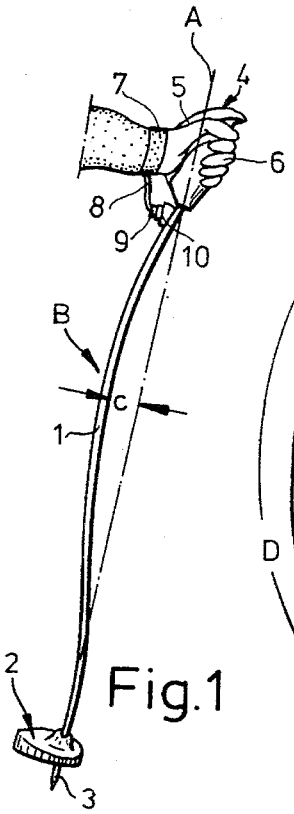
FIG. 1 is an oblique view of a ski pole.

A ski pole B has, at the lower end of a tube 1, a transverse disk 2 with adjacent point 3 and at the upper end a pole grip 4 with grip guard 5; the tube 1 is bent out from its axis A between the disk 2 and the pole grip 4 in such a manner that the distance c from the axis amounts to more than 100 mm.

In FIG. 1 there can be seen a glove 6 which receives the hand of a user and to the wrist support 7 of which there is attached a band 8 which terminates in a block-shaped permanent magnet 9 which rests against a mating magnet 10 on the ski pole B. The band 8 and the pair of magnets 9, 10 replace the customary hand strap.

Figure 2:
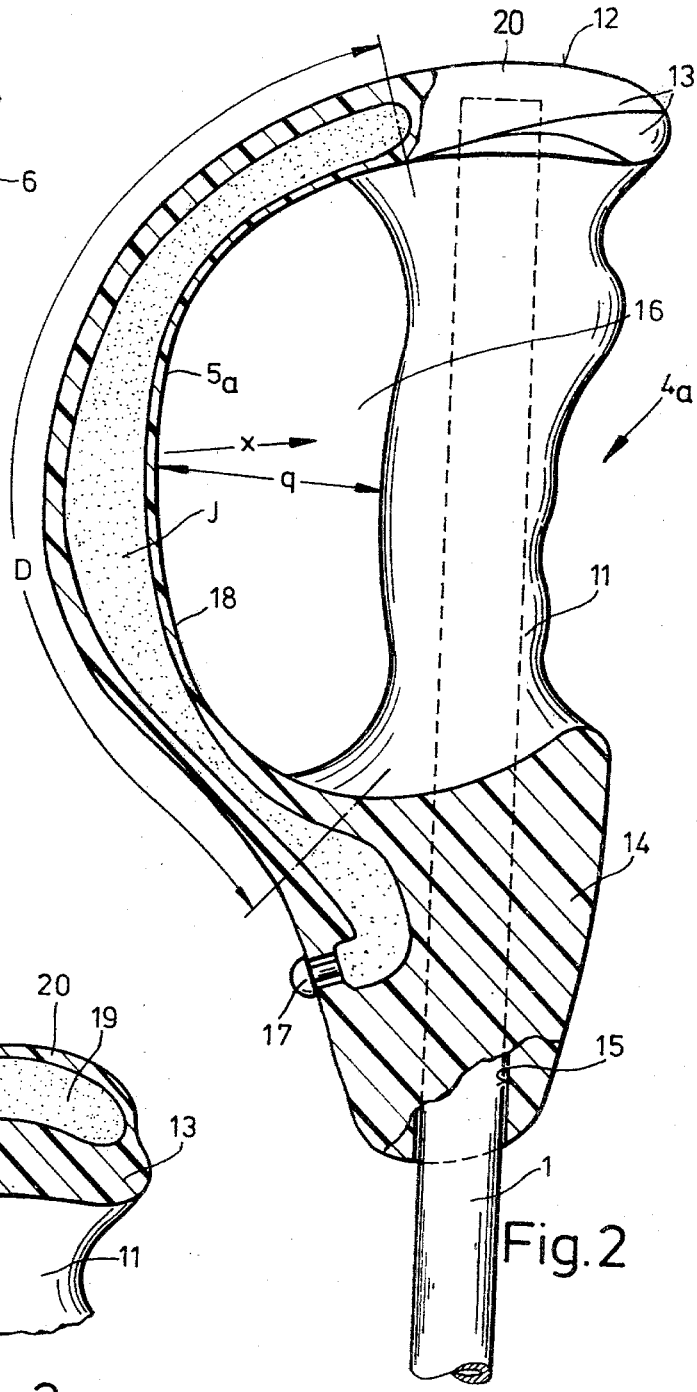
FIG. 2 shows on enlarged scale, the grip end of the ski pole partially in section.

The pole grip $4_a$ shown in FIG. 2 consists of a grip column 11 and the grip guard $5_a$ which is integral with column 11 and passes at the upper end 12 of the ski pole into a flat pommel 13 and at the lower end of the pole grip $4_a$ into a block-shaped fitting 14. The fitting 14 and the grip column 11 are provided with a channel 15 for attachment to the tube 1. The grip guard $5_a$ together with the grip 4*a* define a grip opening 16 and grip guard 5*a* is hollow and is developed in the manner of an inner tube in the region D thereof which defines the grip opening 16. The interior J of the grip guard $5_a$ terminates at a valve indicated at 17 and can be filled with air via said valve.

Upon an increase of the air pressure in the interior J, the flexible wall 18 of the grip guard 11 which faces the grip opening 16 is forced in the direction indicated by the arrow x and the distance q between the wall 18 of the grip guard and the grip column 11 is thereby reduced. This width of opening q can thus be adapted to the specific requirements.

Figure 3:
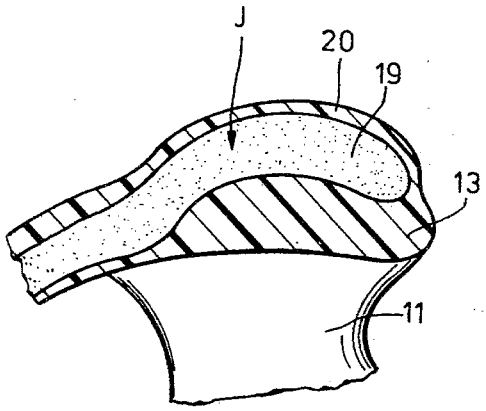
FIG. 3 shows a detail of FIG. 2 according to a different embodiment.

If the air space J is extended up to the pole pommel 13 as indicated in FIG. 3, there is produced on said pommel a supporting air cushion 19 whose upper, flexible, wall 20 can be seen particularly clearly in FIG. 6. The large pommel surface 20 affords increased protection against impact.

Figure 4:
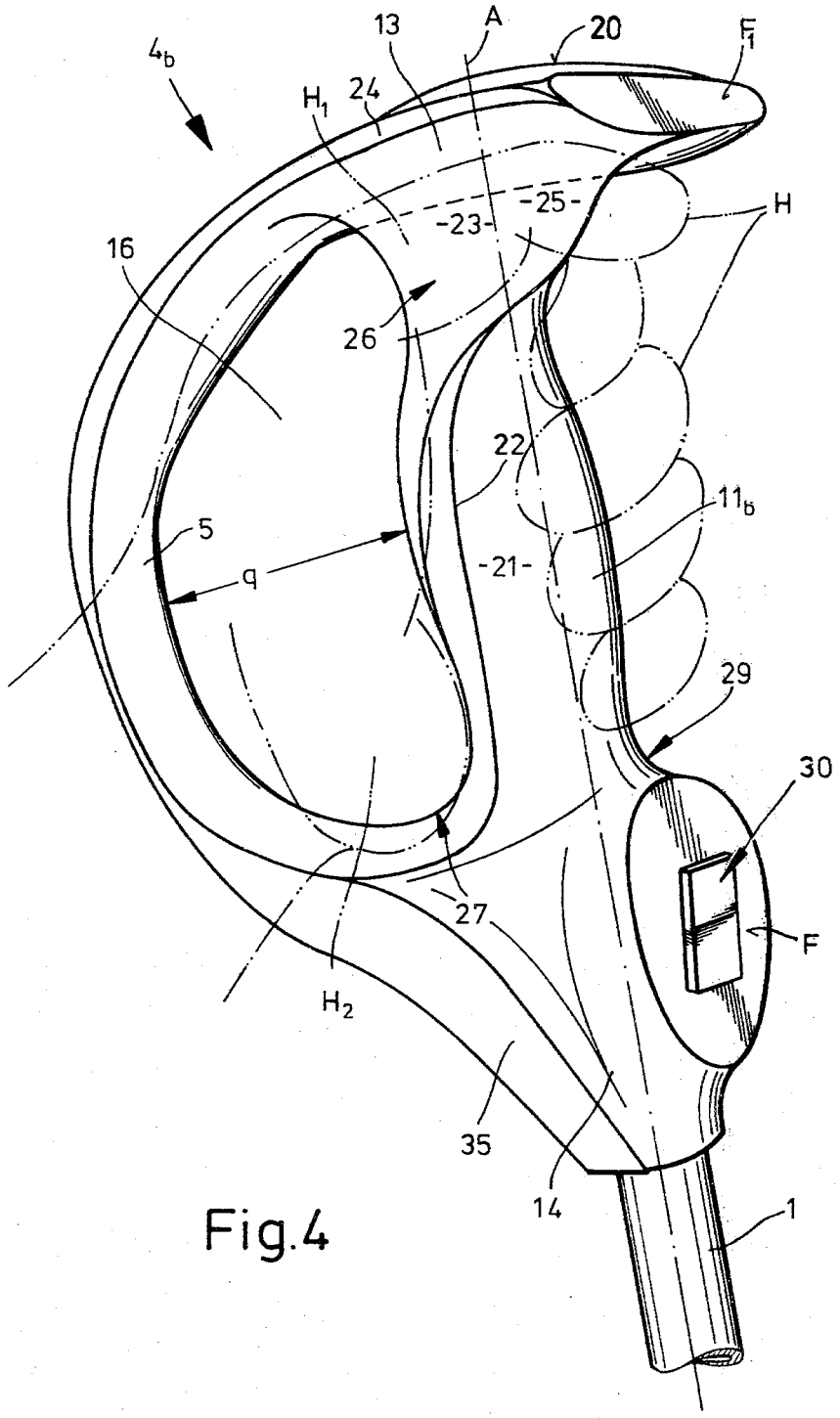
FIG. 4 is an oblique view of a different grip end of the ski pole.
Figure 8:
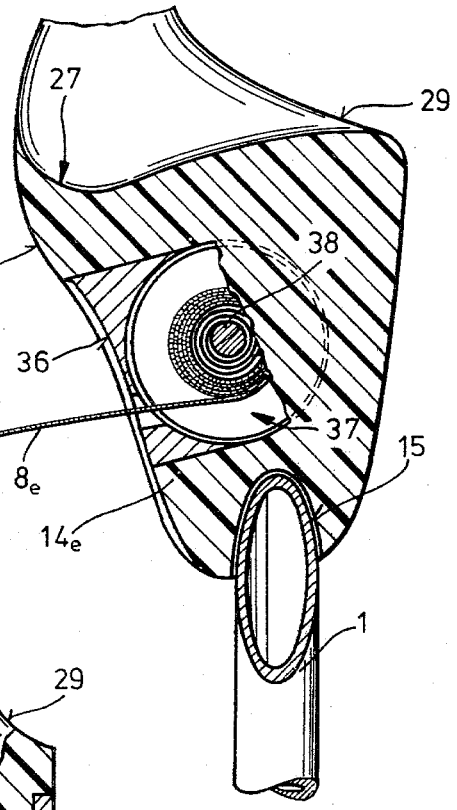
FIG. 8 is a section in FIG. 7 taken along line VII—VII therein.

The grip column $11_b$ of the left-hand pole grip $4_b$ (contour H) shown in FIG. 4 has a fingertip surface 21 which is defined by a curved ridge 22. The latter in turn produces, towards the pommel 13, a shoulder-like resting surface 23 for the thumb $H_1$ which sits in a grip groove 26 provided at the top by another ridge 24 and a mating surface 25 formed by the latter. The ball of the thumb $H_2$ rests on a shell-like inner surface 27 of the block-shaped fitting 14 while the back of the hand rests against the inside of the grip guard 5.

From the block-shaped fitting 14 there is formed a resting surface F of practically oval contour which is approximately parallel to the axis A of the tube 1 and is aligned with a second resting surface $F_1$ on the grip pommel 13. Both resting surfaces F, $F_1$ can be applied against corresponding mating surfaces on another ski pole and be held to each other by permanent magnets 30.

As can be noted with particular clarity from FIG. 6 the rear $11_r$ of the grip column 11 is rounded for the joints of the fingers resting against it. At the tube end of the grip column 11 it passes into a shoulder surface 29 for the resting of the little finger of the hand H. Below this shoulder surface 29 there is provided an indentation 31 in which the valve 17 is seated in protected fashion.

Figure 7:
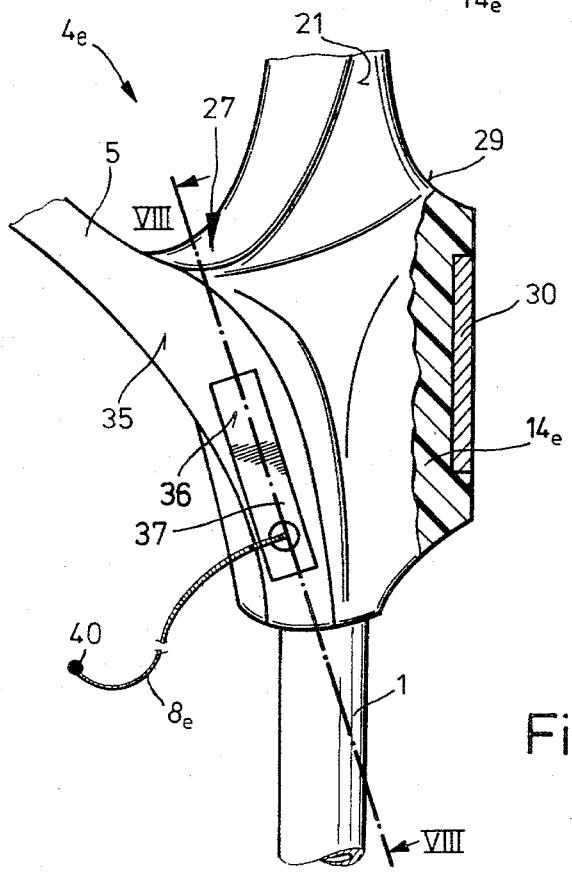
FIG. 7 shows a portion, partially in section, of a grip end.
Figure 10:
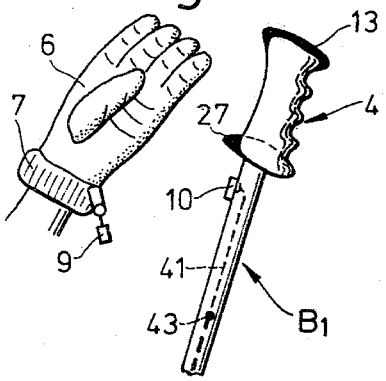
FIG. 10 shows a portion of the ski pole and the hand of a user before grasping the end of the grip.
Figure 11:
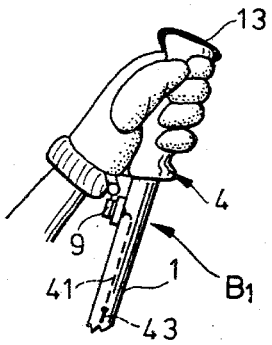
FIGS. 11 to 13 show different positions of the hand or glove with respect to the grip end.
Figure 12:
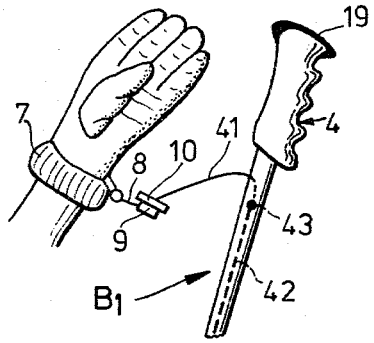
Figure 13:
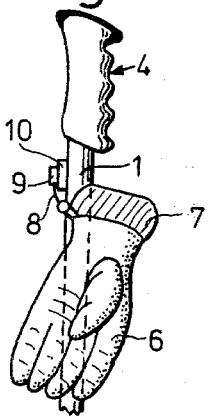
Figure 14:
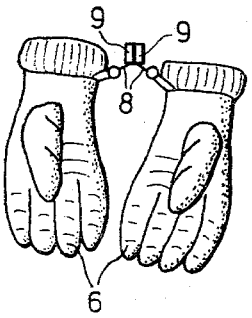
FIG. 14 shows two connected gloves.
Figure 15:
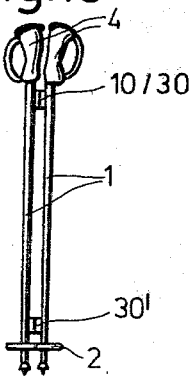
FIG. 15 shows two connected ski poles.

The grip guard 5 extends towards the block-shaped fitting $14_e$ of FIG. 7 in the form of a path-like surface 35. On the latter there can be seen the front surface 36 of a cassette 37 which is inserted into the pole grip $4_e$ and has a chain $8_e$ or the like, which is under the tension exerted by a spring 38. The free end 40 of the chain $8_e$ is fastened to the glove 6 and replaces the magnet connection 9,10 which is in replacement of the customary hand strap.

The magnet 10 of the ski pole $B_1$ of FIGS. 9 to 9*b* is held fast in a box-like mount $41_h$ which, in turn, fits snugly against the tube 1. The mount $41_h$ is under the pull of a rope 41 which, in the example selected, is connected with a force-accumulating device 42, for instance a band spring, which extends along the axis $A_1$ of tube 1, which in this case is straight. A lower permanent magnet $30^1$ of the ski pole $B_1$ can be connected by a rope 41 to a coupling piece 43 of the band spring 42 or else can be connected to an anchoring rope 45 which is seated at 44 in the tube 1.

The rope 41 passes through a borehole 46 in the tube 1, which in order to protect the rope 41 is lined with a sleeve 47.

FIGS. 10 to 14 show the manner of operation of the device:

The glove 6 which is provided with the permanent magnet 9 is placed around the grip 4 and the permanent magnet 9 swings against the pole magnet 10; the two parts 9/10 and 6/$B_1$ are connected together. If the grip 4 is released, the ski pole $B_1$ remains attached to the glove 6 by the permanent magnet 10 which moves with it due to its elastic suspension 41–43. On the other hand, the magnets 9, 10 securely hold an empty glove 6 to the pole $B_1$ or hold the two gloves together.

I claim:

1. The combination of a ski pole and attachment means for detachably connecting said ski pole to the skier in the vicinity of the hand of the skier, said ski pole comprising a tube having a lower pointed end and an upper end, a transverse member on said tube adjacent said pointed end, a hand grip on said tube at said upper end, said attachment means comprising a skier-engagement member and anchoring means of limited elasticity coupling said skier-engagement member with said ski pole in the vicinity of said grip, said anchoring means comprising an anchoring member retractable in and extensible from said ski pole, said anchoring member having one end with means for attachment to said skier-engagement member, and resilient means extending axially within said tube operatively engaging the other end of said anchoring member for biassing said anchoring member to retracted position within said ski pole while permitting extension of the anchoring member from the ski pole and consequent displacement of the skier-engagement member from the ski pole while remaining connected thereto by said anchoring member.

2. The combination as claimed in claim 1 wherein said anchoring means comprises a permanent magnet secured to said skier-engagement member and said means for attachment to said skier-engagement member comprises a second permanent magnet secured to said anchoring member.

3. The combination as claimed in claim 2 wherein said resilient means has a restoring force which is less than the holding force of the magnets.

4. The combination as claimed in claim 2 wherein said anchoring member comprises a rope extending with clearance within said tube.

5. The combination as claimed in claim 4 wherein said second permanent magnet is secured to said rope and in normal position is held against said tube.

6. The combination as claimed in claim 2 further comprising a further permanent magnet on said ski pole in the vicinity of said transverse member for connecting said pole to another pole, and further yieldable connection means between said further permanent magnet and said ski pole for permitting said further permanent magnet to be displaced away from the ski pole.

7. The combination as claimed in claim 1 wherein said skier-engagement member comprises a glove.

8. A ski pole in combination with a glove comprising a tube having a lower pointed end and an upper end, a transverse member on said tube adjacent said pointed end, a hand grip on said tube at said upper end, said hand grip including a grip column and a grip guard cooperatively defining a grip opening for receiving the hand of a user, said hand grip having an upper end constituting an impact surface at the upper end of the pole, said hand grip including a block-shaped fitting mounted on and engaging the upper end of said tube and anchoring means of limited elasticity coupling said glove to said ski pole in the vicinity of said grip, said anchoring means comprising a yieldable connection permitting said glove to be displaced away from said ski pole while remaining connected thereto, said yieldable connection including a resiliently biassed member extending axially within said tube acting to retract the glove towards the ski pole.

* * * * *